US012782090B2

(12) United States Patent
Hertel

(10) Patent No.: US 12,782,090 B2
(45) **Date of Patent: *Nov. 3, 2026**

(54) MOSQUITO INFRARED RECEPTOR BLOCKER COMPOSITION AND SYSTEM

(71) Applicant: Stealth Labs, LLC, Roswell, GA (US)

(72) Inventor: Marc Hertel, Roswell, GA (US)

(73) Assignee: Stealth Labs, LLC, Dahlonega, GA (US)

( * ) Notice: Subject to any disclaimer, the term of this patent is extended or adjusted under 35 U.S.C. 154(b) by 287 days.

This patent is subject to a terminal disclaimer.

(21) Appl. No.: 18/609,491

(22) Filed: Mar. 19, 2024

(65) Prior Publication Data

US 2024/0384970 A1 Nov. 21, 2024

Related U.S. Application Data

(63) Continuation of application No. 18/199,306, filed on May 18, 2023, now Pat. No. 11,933,586.

(51) Int. Cl.

| | |
|---|---|
| ***F41H 3/02*** | (2006.01) |
| ***D06M 11/58*** | (2006.01) |
| ***D06M 11/74*** | (2006.01) |
| ***D06M 101/34*** | (2006.01) |

(52) U.S. Cl.

CPC ..... *F41H 3/02* (2013.01); *D06M 11/58* (2013.01); *D06M 11/74* (2013.01); *D06M 2101/34* (2013.01)

(58) Field of Classification Search

CPC ..... F01H 3/00; F01H 3/02; Y10T 442/259; Y10S 2/90; Y10S 428/919; H01Q 17/004; D06M 11/58; D06M 11/74; D06M 2101/34

See application file for complete search history.

(56) References Cited

U.S. PATENT DOCUMENTS

| | | | | |
|---|---|---|---|---|
| 11,933,586 | B1 * | 3/2024 | Hertel | D06M 11/79 |
| 2008/0227901 | A1 * | 9/2008 | Lefevre | C01F 11/184 524/425 |
| 2010/0112316 | A1 * | 5/2010 | Cincotti | F41H 3/02 204/192.1 |

(Continued)

*Primary Examiner* — Jeremy R Pierce

(74) *Attorney, Agent, or Firm* — Gregory Finch; Finch Paolino, LLC

(57) ABSTRACT

A vector control composite system and methods for producing a vector control strategy capable of blocking mosquito host-seeking cues for reducing the transmission of mosquito-borne diseases. The vector control composite system comprises a substrate coated with a composition further comprising nanoparticles functionalized to block thermal, vibrational, or gray body energy emission of an emitter, thus interfering with mosquito infrared receptor functions for host-seeking. The vector control composite system may comprise a base substrate coated with an IR ceramic coating having an insulation component, a multispectral signature mitigation component, an IR anti-reflective component, whereby the multispectral signature mitigation component and IR anti-reflective component contain functionalized nanoparticles. Embodiments of the vector control composite system may be incorporated in various textiles used as nets, garments, tents, and equipment.

20 Claims, 5 Drawing Sheets

(56) References Cited

U.S. PATENT DOCUMENTS

| | | | | |
|---|---|---|---|---|
| 2015/0027771 | A1* | 1/2015 | Kagawa | H01Q 17/00 174/350 |
| 2019/0100870 | A1* | 4/2019 | Ortega | B32B 5/022 |

* cited by examiner

MOSQUITO INFRARED RECEPTOR BLOCKER COMPOSITION AND SYSTEM

CROSS-REFERENCE TO RELATED APPLICATIONS

The present application is a continuation of U.S. application Ser. No. 18/199,306 filed May 18, 2023, and entitled "MOSQUITO INFRARED RECEPTOR BLOCKER COMPOSITION AND SYSTEM," the entirety of which is incorporated herein by reference.

FIELD

The present disclosure relates to the field of anti-mosquito fabrics; in particular, a fabric composition and system for blocking the infrared receptors of mosquitoes, specifically those sensitive to near-infrared, mid-range and far-infrared wavelengths, comprising a nanoparticle-based composite that can be incorporated into a variety of commercial applications.

BACKGROUND

Mosquito-borne diseases threaten more than 40% of the world's population and are an increasingly serious global health challenge. Mosquitoes act as vectors of pathogens that cause many life-threatening diseases, among which are Malaria, Dengue, Chikungunya, Yellow fever, Zika, West Nile, and Lymphatic filariasis. Mosquitoes are especially pernicious to human health because of their need to feed on blood. Mosquitoes are not reservoirs for pathogens like some other animal-borne illnesses, but rather they shuttle pathogens from affected to unaffected individuals through blood feeding. In addition to civilians, the impact of vector-borne disease on military operations is well known. Military personnel may be exposed to a wide range of vector-borne diseases for which vaccines are unavailable or to which they have no acquired natural immunity; exposure to these vector-borne diseases may impact mission readiness, combat effectiveness, or may even result in death due to allergic reactions. Several chemical, biological, mechanical, and pharmaceutical methods of control are used to reduce the transmission of mosquito-borne diseases in humans. However, these different strategies are facing challenges that include the rapid spread of highly invasive mosquitoes worldwide, the development of insecticide resistance in several mosquito species, outbreaks of novel arthropod-borne viruses, environmental pollution of chemical insecticides, and for military requirements, vector control products with specific properties that require multi-spectral or omni-spectral thermal camouflage and hyperspectral signature mitigation.

Anthropophilic female mosquitoes possess a strong innate drive to find and blood-feed on humans, whose blood provides a protein source needed for egg development. These female mosquitoes rely on a variety of chemical and physical cues including body odor, carbon dioxide ($CO_2$), moisture, visual contrast, and body heat for host seeking and detection. Heat seeking is part of a multimodal host-seeking program activated upon exposure to $CO_2$, with body heat serving as an important cue of being close to the host. The human body emits thermal radiation in the infrared (IR) portion of the electromagnetic spectrum, specifically in the far-infrared range. The peak of this thermal radiation is in the range of 8-15 micrometers (μm). Mosquitoes use infrared vision to locate warm-blooded hosts for feeding, specifically to the blood vessel itself where their proboscis will penetrate with the greatest yield of blood. Their ability to detect the thermal IR radiation, intensity, emitted by hosts is based on the activation of certain receptors in their eyes, antennae, or along their body. Mosquitoes sense temperature through a specialized organ called the maxillary palp, which is located on their head, legs and next to their proboscis. The maxillary palp contains temperature-sensitive neurons that are activated by changes in temperature. These sensilla contain thermo-TRP channels, which are activated by changes in temperature and allow the mosquito to detect temperature gradients in its environment. When the mosquito encounters a warm-blooded animal, the temperature gradient between the animal and the surrounding environment triggers changes in temperature that activate the thermo-TRP channels, specifically the TRPA, TRPV, and TRPM, leading to the generation of electrical signals that are transmitted to the mosquito's brain and enable it to locate the host. Some TRP channels are permeable to calcium ions and can sense changes in calcium levels. In fact, TRP channels are involved in regulating calcium homeostasis in cells, and calcium ions are important second messengers in many cellular signaling pathways. The activation of TRP channels by various stimuli, such as temperature or chemicals, can cause calcium influx into the cell, which can trigger downstream signaling events. In addition to short-range thermal gradients, humans also generate short-range humidity gradients. The two gradients are largely coextensive and form a "boundary layer" of heated, moistened air that surrounds the human body, making humidity a candidate for this parallel cue. Thus, vector control strategies that block these host-seeking cues would be advantageous for reducing the transmission of mosquito-borne diseases in humans as well as developing vector control products that can protect or conceal military service members during deployment and operations in mosquito-prone areas.

SUMMARY

The following presents a simplified summary of some embodiments of the invention to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

An aspect of the present disclosure is a vector control composite system comprising a substrate and coating composition containing at least one nanoparticle (NP) functionalized with chemistry to inhibit thermal, vibrational, or gray body energy source emission, thus blocking or interfering with the function of one or more infrared receptors of a mosquito. In various embodiments, the nanoparticle may comprise inorganic or organic nanoparticles including, but not limited to, metallic nanoparticles, metal oxides, transition metal oxides, carbon-based nanoparticles, fullerenes, graphene, carbon nanotubes (CNT), carbon nanofiber, carbon black, ceramic nanoparticles, semiconductor nanoparticles, lipid based, polymeric, micelles and dendrimers. In various embodiments, the nanoparticle may be functionalized on one or more internal or external surface with at least one chemistry ligand by covalent or non-covalent functionalization to modify the physical, chemical, mechanical, magnetic, electric, thermal resistance, electrical resistance, electrical conductivity and/or electromagnetic property of the coating composition. In various embodiments, the vector control composite system may be configured to block or interfere with one or more mosquito infrared receptors of a neuron membrane, a cell membrane of an innervating neuron, sensory cells located in mosquito antennae, maxillary palps, labellum, neurons innervating coeloconic sensilla in flagellomere, sensilla in flagellomeres 1 and 2, the sensilla ampullaceal, or eyes from detecting a thermal, vibrational energy, or gray body emitter. In various embodiments, the vector control composite system may block or interfere with one or more mosquito photoreceptors of the eyes from detecting a thermal, vibrational energy, or gray body emitter. In various embodiments, the vector control composite system may block or interfere with one or more organs, including the maxillary palp, located on the head, legs, or near a proboscis of a mosquito from detecting a thermal, vibrational energy, or gray body emitter. In various embodiments, the infrared receptor may comprise at least one thermally activated transient receptor potential (TRP) channel, including but not limited to, TRPA, TRP ankyrin 1 (TRPA1), TRPV, TRPC, TRPM subsets, variants, orthologs, opsin, photoreceptor, among others. In various embodiments, the infrared receptor may comprise at least one ionotropic receptor, co-receptor, or ortholog, including but not limited to, Ir21a, Ir25a, Ir40a, Ir68a, Ir93a, among others. The coating composition may comprise one more excipient, binder, formulation, additives, fire retardant (FR), antimicrobial, or emulsifier to enable the composition to be applied to human or animal skin or incorporated into a fabric or textile for various purposes and applications. The thermal, vibrational energy, or gray body energy source or emitter may be a human or animal subject.

An aspect of the present disclosure is a vector control composite system capable of providing multi-spectral or omni-spectral thermal camouflage, and hyperspectral signature mitigation. The vector control system may comprise a moisture vapor permeable base substrate and single infrared (IR) ceramic coating or skin containing at least one said nanoparticle. In various embodiments, the said IR ceramic coating may comprise one or more insulation component, one or more multispectral signature mitigation component, and one or more IR anti-reflective component. In various embodiments, the said IR ceramic coating may comprise one or more insulation component, one or more multispectral signature mitigation component, one or more IR anti-reflective component, said multispectral signature mitigation component and IR anti-reflective component further comprising at least one said NP. In various embodiments, the base substrate layer may comprise any woven, non-woven, knitted, net, or mesh. In various embodiments, the said substrate may comprise spun lace, spun bond, or melt blown non-woven, including polypropylene (PP), polyester (PET), nylon (PA), polyimide, polyamide, viscose fiber, acrylic fiber, polyethene fiber (HDPE), chlorine fiber (PVC), among others. In various embodiments, said substrate may comprise spandex, polyurethane, polypropylene, cotton, wool, co-polymers, other synthetic materials, combinations thereof, among others. In various embodiments, the insulation component may comprise a vinyl acetate thermoplastic resin polymer further comprising a mixture of a fire retardant (FR), preferably phosphorous based, ceramic components, reflective metal, expanded alumina, and pigment. In various embodiments, the multispectral signature mitigation component may comprise one or more radar absorption material (RAM) and boron nitride. In various embodiments, the IR anti-reflective component may comprise calcium carbonate and barium sulfate. The resulting vector control composite system, substrate combined with coating composition, may be cut and sewn for a variety of applications; for example, nets, clothing, garments, tents, and shelters. These applications enable the shielding of thermal, vibrational, or gray body emitter behind or underneath the vector control composite system in a multispectral manner. These applications may further enable resonance with natural frequencies outside of mosquito targeting frequencies while also applying structural design and thermal resonance of a "spider web" structure as an additional avoidance mechanism.

Aspects of the present disclosure provide for a method for constructing a vector control composite system. In a first step, the IR ceramic polymer skin is mixed using a chosen binder, preferably a vinyl or polyvinyl acetate, whereby calcium carbonate is combined with boron nitride, conductive carbon, carbon nanotubes, conductive graphite, or graphite. In a second step, expanded alumina, microcrystalline cellulose is further combined. In a third step, a chosen pigment, antimicrobial, or a fire retardant is further added, and the mixture viscosity is adjusted to enable optimal application to the base substrate. In a fourth step, the IR ceramic coating is coated onto the substrate as a Faraday cage pattern via screen printing. In certain embodiments, the Faraday cage pattern is printed with one or more apertures with diameter in the range of 0.5 mm to 3 mm. In certain embodiments, the plurality of random or ordered apertures are arranged to have a periodic separation distance in the range of 1.0 millimeters to 3.0 millimeters. The screen-printed pattern may comprise an ordered pattern, broken pattern, or a random pattern. In an alternative embodiment, the Faraday cage pattern is blotch coated as a single continuous layer. In another alternative embodiment, the Faraday cage pattern is gravure printed as a solid coating of a thickness corresponding to a chosen insulative value, whereby thicker coatings have higher IR thermal signature mitigation performance. This coating or skin can be mixed in a high or low temperature thermoplastic, polyvinyl acetate, polyvinyl chloride, polyurethane, or silicone binder and printed with a Faraday cage pattern or blotch coated and heated to approximately 300-400 degrees Fahrenheit.

Certain aspects of the present disclosure provide for a vector (e.g., mosquito) control composition comprising a substrate layer comprising a fabric substrate; and an infrared ceramic coating layer disposed on a surface of the substrate layer, wherein the infrared ceramic coating layer comprises an insulation layer, a multi-spectrum signature mitigation layer, and an infrared anti-reflective layer. In accordance with certain embodiments, the insulation layer comprises a vinyl acetate thermoplastic resin polymer. In said embodiments, the multi-spectrum signature mitigation layer comprises at least one radar absorption material. In said embodiments, the infrared anti-reflective layer comprises a plurality of nanoparticles comprising one or more calcium carbonate nanoparticles and one or more barium sulfate nanoparticles.

In accordance with certain embodiments of the vector control composition, the fabric substrate comprises a nylon 6,6 spun bond fabric. The fabric substrate may comprise a plurality of fibers being spun bonded to comprise a webbed arrangement. The multi-spectrum signature mitigation layer comprises one or more boron nitride particles and conductive graphite. The fabric substrate may comprise a mesh fabric having a mesh opening size of less than or equal to 1.5 millimeters. In accordance with certain embodiments, the insulation layer may further comprise one or more of a phosphorous-based fire retardant, ceramic particles, expanded alumina, reflective metal particles, and a pigment.

Further aspects of the present disclosure provide for a vector (e.g., mosquito) control composition comprising a fabric substrate; and an infrared ceramic coating comprising an insulation component, a multi-spectrum signature mitigation component, and an infrared anti-reflective component. In accordance with certain embodiments, the insulation component comprises a vinyl acetate thermoplastic resin polymer. The multi-spectrum signature mitigation component may comprise at least one radar absorption material. The infrared anti-reflective component may comprise a plurality of nanoparticles comprising one or more calcium carbonate nanoparticles and one or more barium sulfate nanoparticles. In certain exemplary embodiments, the infrared ceramic coating comprises a mixture that is disposed on a surface of the fabric substrate.

In accordance with certain embodiments of the vector control composition, the infrared ceramic coating is disposed on the surface of the fabric substrate to define a plurality of random or ordered apertures in the infrared ceramic coating. The infrared ceramic coating may further be disposed on the surface of the fabric substrate to define a Faraday cage pattern. In certain embodiments, each aperture in the plurality of random or ordered apertures comprises a size in the range of 0.5 millimeters to 3 millimeters. Each aperture in the plurality of random or ordered apertures may further be configured to comprise a periodic separation distance in the range of 1.0 millimeters to 3.0 millimeters. In certain embodiments, the fabric substrate comprises a nylon 6,6 spun bond fabric. The fabric substrate may comprise a plurality of fibers being spun bonded to comprise a webbed arrangement. In certain embodiments, the fabric substrate comprises a mesh fabric having a mesh opening size of less than or equal to 1.5 millimeters.

Further aspects of the present disclosure provide for a vector (e.g., mosquito) control composition comprising a plurality of fibers; and an infrared ceramic coating deposited on the plurality of fibers, wherein the infrared ceramic coating comprises an insulation component, a multi-spectrum signature mitigation component, and an infrared anti-reflective component, wherein the plurality of fibers are spun bonded to comprise a textile. In accordance with certain embodiments, the insulation component may comprise a vinyl acetate thermoplastic resin polymer. In said embodiments, the multi-spectrum signature mitigation component comprises at least one radar absorption material. In said embodiments, the infrared anti-reflective component comprises a plurality of nanoparticles comprising one or more calcium carbonate nanoparticles and one or more barium sulfate nanoparticles.

In accordance with certain embodiments of the vector control composition, the plurality of fibers comprise a webbed arrangement when spun bonded to comprise the textile. In said embodiments, the webbed arrangement may comprise a random arrangement of the plurality of fibers. The multi-spectrum signature mitigation component may comprise one or more of boron nitride particles, conductive carbon, conductive graphite, expanded graphite, and graphene. The insulation component may comprise one or more of a phosphorous-based fire retardant, ceramic particles, expanded alumina, reflective metal particles, and a pigment. In certain embodiments, the textile is configured as a wearable garment.

The foregoing has outlined rather broadly the more pertinent and important features of the present disclosure so that the detailed description that follows may be better understood and so that the present contribution to the art can be more fully appreciated.

BRIEF DESCRIPTION OF DRAWINGS

The above and other objects, features and advantages of the present disclosure will be more apparent from the following detailed description taken in conjunction with the accompanying drawings, in which.

DETAILED DESCRIPTION

Figure 1:
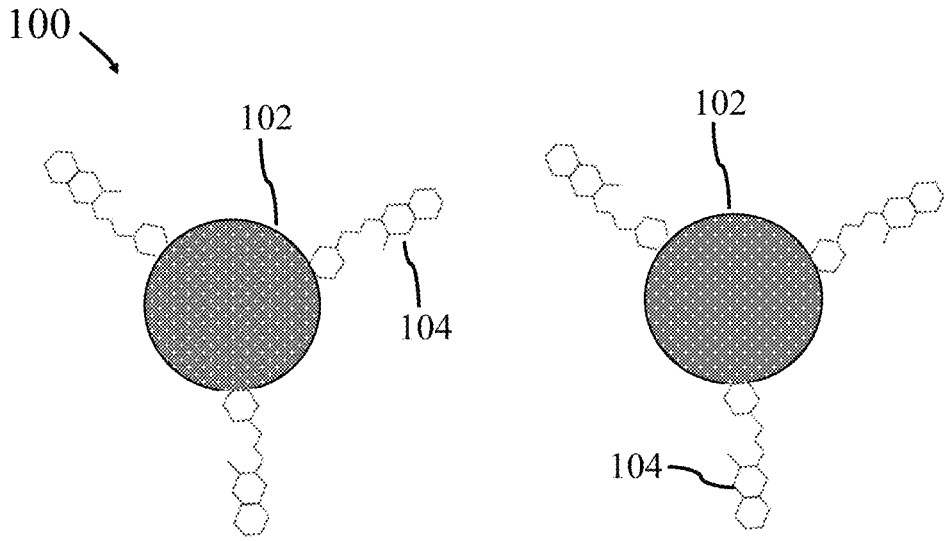
FIG. 1 is an illustration of a nanoparticle functionalized with ligands, in accordance with certain aspects of the present disclosure.

It should be appreciated that all combinations of the concepts discussed in greater detail below (provided such concepts are not mutually inconsistent) are contemplated as being part of the inventive subject matter disclosed herein. It also should be appreciated that terminology explicitly employed herein that also may appear in any disclosure incorporated by reference should be accorded a meaning most consistent with the concepts disclosed herein.

It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes. The present disclosure should in no way be limited to the exemplary implementation and techniques illustrated in the drawings and described below.

Where a range of values is provided, it is understood that each intervening value, to the tenth of the unit of the lower limit unless the context clearly dictates otherwise, between the upper and lower limit of that range and any other stated or intervening value in that stated range is encompassed by the invention. The upper and lower limits of these smaller ranges may independently be included in the smaller ranges, and are also encompassed by the invention, subject to any specifically excluded limit in a stated range. Where a stated range includes one or both endpoint limits, ranges excluding either or both of those included endpoints are also included in the scope of the invention.

As used herein, the term "includes" means includes but is not limited to, the term "including" means including but not limited to. The term "based on" means based at least in part on.

As used herein, the term "omni-spectral" means, but is not limited to, the wavelength range of X-ray, UV, visible, near infrared (NIR), infrared (IR), mid-range IR (MWIR), SWIR, LWIR, far IR, millimeter, radar radio waves (i.e., $10^{-10}$ to $10^{8}$ meter).

As used herein, the term "black body" radiation means the thermal electromagnetic radiation within or surrounding a body in thermodynamic equilibrium with its environment, emitted by a black body (an idealized opaque, non-reflective body).

As used herein, the term "gray or gray body" means an object with an emissivity less than unity (i.e., less than 1) and the same at all wavelengths, by comparison with a black body that has unit emissivity or emissivity equal to 1, at all wavelengths.

As used herein, the term "Gray Body Diffusion" means an object possessing a relatively similar emissivity through the thermal IR (TIR) spectra.

As used herein the term "stealth coating" means, but is not limited to, a combination of one, two, or more layers of stealth polymer mixture to the surface of a substrate.

As used herein, the term "nonwoven" or "non-woven" is a broad term encompassing almost any fabric or textile which is made without weaving fibers together (i.e., loom).

As used herein, the term "fabric" comprises any material produced by the joining of one or more fibers or filaments.

As used herein, the term "spun lace" is the process of producing an entanglement of and/or stealth coated fibers (metallic conductive fibers) or materials or fabrics by means of heavy water jets at very high pressures through jet orifices with very small diameters.

As used herein, the term "spun bond or spun bonding" is a process for forming nonwoven fabrics or resulting fabrics by bonding continuous-filament synthetic fibers and/or stealth coated fibers (above) immediately after extrusion.

As used herein, the term "Faraday cage" is a volume surrounded by conductive walls with openings, quilting or apertures capable of neutralizing an external EM field or shielding against an external EM field, such openings, quilting or apertures being sized to prevent EM field coupling for one or more specific wavelengths through the openings, quilting or apertures.

As used herein, the term "Faraday cage pattern" is a pattern of openings or apertures of a Faraday cage. An example is the metal screen with holes on the door of a microwave oven. The screen keeps the microwaves contained within the oven while allowing light, with its much shorter wavelength, to pass through. This pattern assists in electrical conduction/TIR absorption of the stealth coating and assists in transmission.

As used herein, the term "ligand" is defined as any atom, molecule, small molecule, or macromolecule capable of modifying the physical or chemical property of a nanoparticle and a mixture of nanoparticles or resulting composite structure containing nanoparticles.

As used herein, "exemplary" means serving as an example or illustration and does not necessarily denote ideal or best.

Certain objects and advantages of the present disclosure include a vector control composite system comprising nanoparticles capable of blocking the thermal, vibrational, or gray body energy emission of an emitter thus inhibiting mosquito infrared host-seeking cues, specifically those sensitive to near infrared (IR), mid-range, and far-infrared wavelengths. The technology vector control composite system can be applied to skin or textiles used as nets, garments, tents, and equipment to effectively render the subject invisible to mosquitoes' infrared vision and sensitivity.

Exemplary embodiments of the present disclosure include one or more vector control composite system and methods for producing one or more vector control strategies capable of blocking mosquito host-seeking cues for reducing the transmission of mosquito-borne diseases in humans as well as developing vector control products that can protect or conceal military service members during deployment and operations. The vector control composite system comprises a substrate coated with a composition further comprising nanoparticles functionalized to block thermal, vibrational, or gray body energy emission of an emitter thus interfering with mosquito infrared receptor functions for host-seeking. The vector control composite system comprises a base substrate coated with an IR ceramic coating having an insulation component, a multispectral signature mitigation component, and an IR anti-reflective component, wherein the multispectral signature mitigation component and the IR anti-reflective component contain one or more functionalized NPs. The vector control composite system is capable of blocking mosquito infrared receptors from activating itself into host-seeking behaviors at the receptor protein, thermal, vibrational, and chemical level by purposely obscuring a thermal, vibrational, or gray body emitter such as a human or animal with a conductive textile. The textile or fabric is designed specifically to mimic a spider web in nature. The method comprises steps for the construction of the vector control composite system. The composite system is incorporated in various textiles used as nets, garments, tents, and equipment to expand the commercial mosquito mitigation options as well as to meet the demands of contemporary and future military stealth missions.

Reconnaissance modalities, such as radar, use an emitting element to transmit a radiation beam. When such beams encounter an object, they are reflected by the object and returned to the radar. The radar receiver receives the reflected radiation, which is subjected to time analysis (to determine the distance to the detected object) and amplitude-phase analysis (to determine the type of object detected). This mode of operation of radar devices means that the only effective countermeasure is to minimize reflected radiation, resulting in either a lack of detection or, should detection occur, incorrect identification of the object. It is generally accepted that radars operate in the range of electromagnetic radiation, mostly in the centimeter and millimeter wave spectrum. However, battlefield radar and tracking radars work in different wavelengths, from 1 to 20 GHz, 35 GHz, and 94 GHz.

Camouflage in the radar range focuses on at least two aspects: reducing the radar cross section (RCS) of objects so that a minimal proportion of the radiation emitted by the radar returns to it as the result of being reflected from the object; deformation/blurring of the radar signature of the object camouflaged to eliminate or change the details of the radar signature to obscure recognition/identification of the object. Another approach is to use microwave absorbers.

The absorption of electromagnetic (EM) wave radiation and propagation is a process by which the energy of an EM wave is turned off and then transformed into other energies by interference with an EM wave absorbing material, through which the EM wave cannot be reflected or transmitted. Ideal EM wave absorbing materials should have two basic properties: (1) the intrinsic impedance of the material is equal to the impedance of the free space (impedance matching) and (2) the EM wave in the material is rapidly attenuated. These conditions require strong magnetic and/or dielectric loss exhibition.

Electromagnetic energy/waves consists of magnetic (H-field) and electric (E-field) components that are perpendicular to each other, and which propagate at right angles to the plane containing the two components. The ratio of E to H is defined as the wave impedance ($Z_w$, in ohms Ω) and depends on the type of source and the distance from the source. Large impedances characterize electric fields and small impedances characterize magnetic fields. Far from the source, the ratio of E to H remains constant and equal to 377Ω, which is the intrinsic impedance of free space.

A radar absorbing material (RAM) reduces the energy reflected back to the radar by means of absorption. The main requirements of RAMs are effective EM wave impedance and good attenuation at the surfaces of a RAM that result in a good match for the incoming signal once it penetrates the material. RAMs can be categorized into two types: dielectric and magnetic absorbers, which means that the absorption is primarily due to their dielectric and magnetic characteristics, respectively.

The amount of attenuation offered by an absorber depends on three mechanisms. The first is usually a reflection of the wave from the shield/absorber. The second is an absorption of the wave into the absorber as it passes through the absorber. The third is due to the re-reflections, i.e., the multiple reflections of the waves at various surfaces or interfaces (e.g., air, material) in the shield/absorber. The reflection loss is a function of the ratio $S_r/M_r$, whereas the absorption loss is a function of the product $S_r$ times $M_r$, where $S_r$ is the electrical conductivity of the absorber relative to copper and $M_r$ is the magnetic permeability of the shield/absorber relative to free space. The EMI shielding/absorption efficiency (SE), reported as reduction of transmitted wave power, includes the shielding effects due to absorption, reflection, and multiple reflections. Due to multiple reflections inside of a shielding/absorbing material, there can also be after-effects like secondary reflection and secondary transmission.

Polymer fabrics or matrices are generally non-magnetic and do not make any magnetic contribution to EM wave attenuation. The absorption by the dielectric materials depends on dielectric loss mechanisms, such as electronic/atomic polarization, orientation (dipolar) polarization, ionic conductivity, and interfacial or space charge polarization. Magnetic loss mechanisms include hysteresis loop (from irreversible magnetization, which is negligible in a weak applied field), domain wall resonance (which usually occurs in the frequency range 1-100 MHz), Natural Resonance, and Eddy current losses. According to Poynting's theorem, there is a directional energy flux density of an EM wave (Poynting vector) that is defined as the cross product of the magnetic field vector and the electric field vector. This means that attenuation of EM waves requires not only electronic contribution, but magnetic as well. However, both dielectric and magnetic materials have relatively low absorption when they are used independently. Therefore, it is ideal to enhance absorption characteristics when dielectric materials are coated or blended with micro-nanomaterials, such as metallic flakes or particles.

Spectral absorption features observed in the visible to short-wave infrared wavelength region result from several distinct processes. In the spectral range from 0.4 to approximately 1.2 micrometer (μm), absorption features are produced mainly by energy level changes in the valence electrons of transition metals, by paired excitations of metal cations, or by charge transfer between metal cations and their associated ligands. Intervalence charge transfer (IVCT) transitions in the visible and near-IR region are transitions in which an electron, through optical excitation, is transferred from one cation to a neighboring cation. Compounds containing an element in two different oxidation states, mixed valence compounds, often show intense absorption in the visible region which can be attributed to IVCT transitions.

Molecular vibration processes generate absorption features in the SWIR (1.3-2.5 μm) and the long infrared (LWIR) wavelength range. Common absorption features in the SWIR wavelength range include 2.18-2.22 μm bands related to Al—O—H combination bands in aluminous materials, such as aluminum flakes. In the mid- and far-IR, away from inter-band transitions, coupling to collective oscillations of free-carriers, called plasmons, and vibrations of the crystal lattice in polar materials can significantly affect the permittivity of a material. Hafnium dioxide ($HfO_2$), the most stable form, is a polar crystal with strong absorption from the IR active optical phonon modes. Boron Nitride (BN) is synthesized as white powders and preferentially grows in the hexagonal structure, similarly to graphite. The transmission spectrum for BN deposited on a germanium multiple internal reflection (MIR) plate have been measured from 2.5 to 50 μm by spectrophotometry. In addition, absorption studies of BN-on-quartz have also been made in the 0.19 to 3.2 μm range. Several absorption bands are known in the transmission spectrum for BN-on-Ge. The peak at 6.9 μm is due to the B-N bending mode. The maximum near 6.5 μm is associated with N=0. The B-H vibration is observed at 4 μm. A broad structure in the vicinity of 2.9 μm results from 0-H. Similarly, spectroscopic measurements of Barium Nitrate show infrared absorption bands at 4.2, 5.6, 7, 7.4, 11.6 and 13.6 μm. The absorption properties of these micro-nano particles make them ideal for incorporation into high performance thermal camouflage, thermal signature mitigation and thermal insulation solutions for stealth applications.

Mosquitoes use infrared vision to locate warm-blooded hosts for feeding, specifically to the blood vessel itself where its probiscis will penetrate with the greatest yield of blood. Their ability to detect the thermal radiation emitted by hosts is based on the activation of certain receptors in their eyes, antennae or along their body. Mosquitoes sense temperature through a specialized organ called the maxillary palp, which is located on their head, legs and next to their proboscis. The maxillary palp contains temperature-sensitive neurons that are activated by changes in temperature.

When a mosquito is searching for a host, it detects the heat and carbon dioxide that humans and other warm-blooded animals emit. As the mosquito gets closer to the host, it uses its maxillary palp to detect the temperature gradient between the host's skin and the surrounding environment. This allows the mosquito to pinpoint the exact location of the host's blood vessels, where it can insert its proboscis to feed. A mosquito has adapted four components to its ability to target prey. First is carbon dioxide ($CO_2$) sensing mechanisms to detect $CO_2$ clouds emitted by living organisms into the air. This is a long-range targeting function. Next is a mechanosensory function on identifying movement, chemistry and smell. This is performed in the Johnston's organ, also known as the antennal mechanosensory and/or auditory organ, which is in the mosquito's antennae and is responsible for detecting vibrations and changes in air pressure. This organ is crucial for mosquitoes' ability to fly, navigate, and locate hosts. The Johnston's organ is composed of sensory neurons that are surrounded by support cells and covered by a cuticular cap. The neurons have hair-like structures called sensory cilia that extend from the cell body and are embedded in the cap. When a mosquito is flying or in close proximity to a host, the movement of air causes the antennae to vibrate. These vibrations are transmitted to the Johnston's organ and cause the sensory cilia to bend. This bending of the cilia activates the sensory neurons, which generate electrical signals that are sent to the mosquito's brain. The brain then interprets these signals to determine important information such as the speed and direction of movement, the proximity of an object, and the presence of a host. This information is essential for mosquitoes to navigate and locate hosts, as well as to avoid obstacles and potential predators.

Mosquitoes do not see or sense infrared (IR) radiation through their Johnston's organ. Instead, they use specialized sensory cells in their antennae and eyes called IR-sensitive neurons, which are distinct from the mechanosensory neurons in the Johnston's organ, to zoom in and get closer than a six-foot radius to the target. As previously stated, when a mosquito is searching for a host, it first detects the carbon dioxide and other exhaled chemicals and humidity to guide it to the general vicinity of the host. Then, as the mosquito gets closer, it can sense movement, chemicals and scent. But within six feet of the target, it must use its IR-sensing abilities to detect the warmth of the host's body and target a specific location. If it does not locate a host in IR along three bands of wavelength, it is considered not suitable for its needs for reproduction and the mosquitoes abandon the potential target.

As a mosquito closes in on the potential target based on $CO_2$ and movement, scent, and humidity, it uses its vision. Mosquitoes can see in the IR range because their eyes contain specialized cells called photoreceptors and opsins, which are sensitive to different wavelengths of light, including IR. These photoreceptors can detect variations in IR radiation, which are converted into electrical signals that are sent to the mosquito's brain, allowing it to "see" in the IR spectrum. These are the first sensors to obscure to avoid a female mosquito's bite. These opsins are important in function, as Rhodopsin and some other long range IR opsins enable a mosquito to see in low light conditions and see colors, such as red and NIR.

One example of a natural source of energy that emits in the near-infrared (NIR) portion of the electromagnetic spectrum is the Sun. While the Sun emits radiation across a wide range of wavelengths, including visible light and ultraviolet radiation, it also emits radiation in the NIR range. This radiation is primarily absorbed by the Earth's atmosphere and contributes to the planet's overall emissivity balance with vegetation and minerals, playing a key role in the Earth's climate system and the natural world of the mosquito. This is the difference of contrast of a target host against the ambient reflectivity of nature. Therefore, this would be the first IR band to defeat or block from a visible to NIR band to avoid mosquito host-seeking, blocking the function of Rhodopsin in the retina. It is worth noting that mosquito vision in the IR spectrum is not as well-developed as their ability to sense temperature changes, and they likely rely more on their thermal sense to locate hosts. However, the ability of a mosquito to sense IR radiation does play a role in host-seeking behavior and may contribute to its ability to distinguish between different hosts based on temperature. Therefore, a mosquito relies more on its thermal sensing capabilities to locate potential hosts, but its IR vision does play a role in this process.

A mosquito does not sense infrared (IR) radiation through its Johnston's organ or eyes. Instead, it uses specialized sensory cells on the body called IR-sensitive neurons located in the maxillary palp, which are distinct from the mechanosensory neurons in the Johnston's organ. These sensory cells utilize a functional group called thermoreceptors such as the TRPA1, TRPV1, and IR21a receptors in mosquitoes. These receptors are all members of the transient receptor potential (TRP) ion channel family, which are involved in thermo-reception and other sensory processes. The IR-sensitive neurons contain proteins that are sensitive to specific wavelengths of light, including those in the IR spectrum. When these proteins absorb IR radiation, they undergo a conformational change that generates an electrical signal. This signal is then transmitted to the mosquito's brain, which interprets it as a visual image. It is therefore important to block electrical signals at the neural level to avoid targeting.

Mosquitoes have two types of IR-sensitive neurons to block to avoid targeting at NIR and Mid-range IR: one that is sensitive to near-infrared light (wavelengths between 750 and 1400 nanometers) and another that is sensitive to far-infrared light (wavelengths between 1400 and 3000 nanometers). This allows them to see heat emitted by warm-blooded animals and to distinguish between different temperatures. Far IR sensing of mosquitoes is also generated at the 8000 nm-15000 nm range. The human host body emits thermal radiation in the infrared (IR) portion of the electromagnetic spectrum, specifically in the far-infrared range. The peak of human thermal radiation is in the range of 8-15 micrometers (μm), which falls within the range of wavelengths that mosquitoes can sense. However, the exact range of wavelengths emitted by the human body can vary depending on a variety of factors, including body temperature, clothing, and environmental conditions. The mosquito's sensitivity to specific wavelengths may vary depending on the species and physiological factors.

Mosquitoes can sense thermal radiation using specialized sensory organs called thermal sensilla, which are located on their antennae, maxillary palps, and proboscis. These sensilla contain thermo-TRP channels, which are activated by changes in temperature and allow the mosquito to detect temperature gradients in its environment. When the mosquito encounters a warm-blooded animal, the temperature gradient between the animal and the surrounding environment triggers changes in temperature that activate the thermo-transient receptor potential (TRP) channels, leading to the generation of electrical signals that are transmitted to the mosquito's brain and enable it to locate the host. TRP channels are grouped into seven subfamilies, with known thermo-TRP channels being in the TRPA, TRPV, TRPC, and TRPM subsets. TRPV channels are not directly sensitive to infrared (IR) wavelengths. Instead, they are sensitive to changes in temperature, with a typical activation threshold in the range of 25-40° C., which corresponds to the normal body temperature of warm-blooded animals, including humans. By blocking these receptors, it is possible to prevent mosquitoes from detecting human or animal hosts. This can be done by blocking thermal signature in three specific bandwidths in a uniform manner. Some TRP channels are permeable to calcium ions and can sense changes in calcium levels. TRP channels are known to be involved in regulating calcium homeostasis in cells, and calcium ions are important second messengers in many cellular signaling pathways. The activation of TRP channels by various stimuli, such as temperature or chemicals, can cause calcium influx into the cell, which can trigger downstream signaling events. Thermally insulative materials commonly found in nature can also block thermal signature. Calcium carbonate, an inorganic salt, is also known to affect the protein receptors of TRPs.

The human body does not emit significant amounts of radiation in the near-infrared (NIR) portion of the electromagnetic spectrum. Instead, the NIR range is primarily associated with reflected light from the environment, such as sunlight reflecting off surfaces. The use of NIR radiation to detect temperature changes in the body or to image tissues is common in medical diagnostics and imaging. The method of detection using NIR therefore mirrors a mosquito's ability to target blood vessels directly with their proboscis for the exact location to draw blood. For example, near-infrared spectroscopy (NIRS) is a non-invasive medical imaging technique that uses NIR light to measure changes in the concentration of oxygenated and deoxygenated hemoglobin in tissues. Therefore, it is important to duplicate nature's emissivity first in NIR band for a human concealment from mosquito host-seeking and specifically on the reflective surface of the skin.

Mid-range and far range spikes in thermal signature are important in shielding emissivity of body heat to avoid mosquito targeting as they close in beyond $CO_2$ cloud location. The temperature-sensitive neurons in the maxillary palp are activated by changes in temperature, and the resulting electrical signals are transmitted to the mosquito's brain, which processes the information and directs the mosquito to the host's location. Mosquitoes are particularly sensitive to temperature changes of a few degrees Celsius, which is sufficient for them to detect the warmth of a host's body. In addition to the maxillary palp, mosquitoes also have thermal receptor neurons located on their legs and wings, which may help them to navigate and avoid hot surfaces. Mosquitoes use a combination of these thermal and visual cues to locate and feed on hosts, as well as to avoid potential dangers. These IR-sensitive neurons contain proteins called opsins that are sensitive to specific wavelengths of light, including those in the IR spectrum. When opsins absorb IR radiation, they undergo a conformational change that generates an electrical signal. This signal is then transmitted to the mosquito's brain, which interprets it as a visual image.

Mosquitoes have two types of IR-sensitive neurons: one that is sensitive to near-infrared light (wavelengths between 750 and 1400 nanometers) and another that is sensitive to mid-infrared light (wavelengths between 1400 and 3000 nanometers) and far infrared light 8-15 μm. This allows them to see heat emitted by warm-blooded animals and to distinguish between different temperatures. At the molecular level, the neurons in a mosquito's receptor system that sense heat and temperature changes are activated by specific temperature-sensitive proteins called thermo-TRP channels or thermal sensors. These channels are found on the surface of the neurons and are sensitive to changes in temperature, causing the channels to open or close depending on the temperature of the surrounding environment. When the temperature-sensitive proteins are activated by a change in temperature, they cause a flow of ions, such as calcium or sodium, into the neuron, which generates an electrical signal. This signal is then transmitted to the brain of the mosquito via the nervous system. The precise mechanisms by which thermal sensors operate are still not fully understood, but studies have shown that they are involved in a range of processes such as thermoregulation, pain perception, and taste sensation in various organisms including mosquitoes. In summary, at a molecular level, the activation of thermo-TRP channels on the neurons in a mosquito's receptor system causes a flow of ions and generates an electrical signal, which is then transmitted to the brain, allowing the mosquito to detect changes in temperature and respond to them accordingly. Within the channel, there are several amino acid residues that are critical for temperature sensing. These residues act as sensors of thermal energy, and they undergo a conformational change in response to changes in temperature. Specifically, as the temperature increases, the shape of these residues changes, which causes the channel to open, allowing ions to flow into the neuron and generate an electrical signal. The exact molecular mechanism by which the amino acid residues sense changes in temperature is not fully understood. However, it is thought to involve the movement of charged atoms, such as protons, within the protein structure, which can change the shape of the protein and ultimately cause it to open or close. In summary, at the molecular level, temperature-sensitive proteins, such as thermo-TRP channels, are composed of multiple subunits that form a complex pore structure. Within this structure, specific amino acid residues act as sensors of thermal energy and undergo conformational changes in response to changes in temperature, leading to the opening or closing of the channel and the generation of an electrical signal in the neuron. When a mosquito encounters a warm-blooded host, such as a human, the heat from the host triggers a series of biochemical and physiological responses in the mosquito, including the activation of thermo-TRP channels on the surface of its neurons. These channels allow positively charged ions, such as calcium and sodium, to flow into the neurons, leading to the generation of electrical signals that are transmitted to the mosquito's brain.

Thermo-TRP channels are sensitive to different frequency ranges depending on their type. For example, TRPA channels are sensitive to temperatures in the range of 17-28° C. and are involved in detecting cool temperatures. TRPV channels are sensitive to temperatures in the range of 25-40° C. and are responsible for detecting warm temperatures. TRPM channels are sensitive to a wider range of temperatures, including both warm and cool temperatures, and are involved in various physiological processes, including thermal sensation, pain sensation, and taste perception. TRPV channels are not directly sensitive to infrared (IR) wavelengths. Instead, they are sensitive to changes in temperature, with a typical activation threshold in the range of 25-40° C., which corresponds to the normal body temperature of warm-blooded animals, including humans. However, some studies have suggested that TRPV channels can be indirectly activated by exposure to IR radiation. This is because IR radiation can heat up the tissue and trigger changes in temperature that activate the TRPV channels. The specific wavelengths of IR radiation that can activate TRPV channels depend on the intensity and duration of exposure, as well as the tissue type and the species of the organism. Therefore, while TRPV channels are not directly sensitive to IR wavelengths, they can be activated by changes in temperature that are induced by exposure to IR radiation.

An aspect of the present disclosure is a vector control composite system comprising a substrate and coating composition containing at least one nanoparticle (NP) functionalized with chemistry to inhibit thermal, vibrational, or gray body energy source emission thus blocking or interfering with the function of one or more infrared receptors of a mosquito. Referring now to FIG. 1, illustration 100 of a nanoparticle 102 is shown, according to various embodiments. For illustrative purposes, several ligands are shown attached or linked to nanoparticle 102. In various embodiments, nanoparticle 102 may comprise inorganic or organic nanoparticles, including metallic nanoparticles, metal oxides, transition metal oxides, carbon-based nanoparticles, fullerenes, graphene, carbon nanotubes (CNT), carbon nanofiber, carbon black, ceramic nanoparticles, semiconductor nanoparticles, lipid-based nanoparticles, polymeric nanoparticles, micelles, and dendrimers, among others. In various embodiments, nanoparticle 102 may be functionalized on one or more internal or external surface with at least one chemistry ligand by covalent or non-covalent functionalization to modify the physical, chemical, mechanical, magnetic, electric, thermal resistance, electrical resistance, electrical conductivity, electromagnetic property, and combinations thereof and the like, of the coating composition. In various embodiments, the vector control composite system may block or interfere with one or more mosquito infrared receptors of a neuron membrane, a cell membrane of an innervating neuron, sensory cells located in mosquito antennae, maxillary palps, labellum, neurons innervating coeloconic sensilla in flagellomere, sensilla in flagellomeres 1 and 2, the sensilla ampullaceal, or eyes from detecting a thermal, vibrational energy, or gray body emitter. In various embodiments, the vector control composite system may block or interfere with one or more mosquito photoreceptors of the eyes from detecting a thermal, vibrational energy, or gray body emitter. In various embodiments, the vector control composite system may block or interfere with one or more organs, including the maxillary palp, located on the head, legs, or near a proboscis of a mosquito from detecting a thermal, vibrational energy, or gray body emitter. In various embodiments, the vector control composite system may block the infrared receptors of mosquitoes sensitive to mid-range and far-infrared wavelengths. In various embodiments, the infrared receptor may comprise at least one thermally activated transient receptor potential (TRP) channel, including but not limited to, TRPA, TRP ankyrin 1 (TRPA1), TRPV, TRPC, TRPM subsets, variants, orthologs, opsin, photoreceptor, among others. In various embodiments, the infrared receptor may comprise at least one ionotropic receptor, co-receptor, or ortholog, including but not limited to, Ir21a, Ir25a, Ir40a, Ir68a, Ir93a, among others. The coating composition may comprise one more excipient, binder, formulation, additives, fire retardant (FR), antimicrobial, or emulsifier to enable the composition to be applied to human or animal skin or incorporated into a fabric or textile for various purposes and applications. The thermal, vibrational, or gray body energy source or emitter may be a human or animal, including but not limited to, the wavelength range between 8000 nm to 15000 nm, among others.

Figure 2:
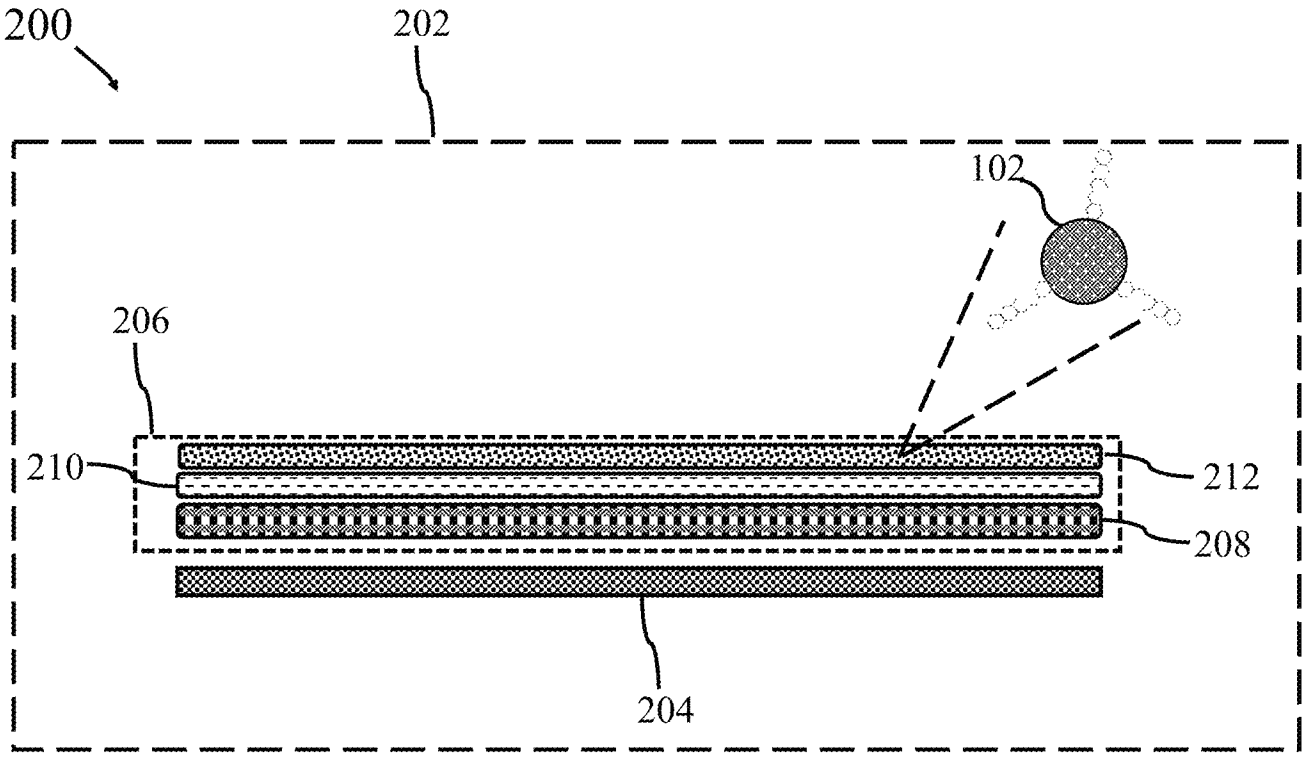
FIG. 2 is an illustration of a vector control composition and system, in accordance with certain aspects of the present disclosure.

An aspect of the present disclosure is a vector control composite system capable of providing multi-spectral or omni-spectral thermal camouflage, and hyperspectral signature mitigation. Referring now to FIG. 2, an illustration 200 of vector control composite system 202 is shown, according to various embodiments. The vector control composite system 202 may comprise a moisture vapor permeable base substrate 204 and single infrared (IR) ceramic coating or skin 206. In various embodiments, the said IR ceramic coating 206 may comprise one or more insulation component 208, one or more multispectral signature mitigation component 210, and one or more IR anti-reflective component 212. In various embodiments, the said IR ceramic coating 206 may comprise one or more insulation component 208, one or more multispectral signature mitigation component 210, and one or more IR anti-reflective component 212 comprising one or more nanoparticles 102. In various embodiments, the base substrate layer 204 may comprise any woven, non-woven, knitted, net, or mesh material. In various embodiments, base substrate layer 204 may comprise a spun lace, spun bond, or melt blown non-woven, including polypropylene (PP), polyester (PET), nylon (PA), polyimide, polyamide, viscose fiber, acrylic fiber, polyethene fiber (HDPE), chlorine fiber (PVC), among others. In a preferred embodiment, base substrate layer 204 may comprise a spun bond or spun bond nylon 6,6 (Cerex Advanced Fabrics, Inc., Cantonment, FL) produced by spinning and autogenously bonding continuous filaments of nylon 6,6 into a thin, smooth strong nonwoven fabric. In various embodiments, base substrate layer 204 may comprise spandex, polyurethane, polypropylene, cotton, wool, co-polymers, other synthetic materials, and combinations thereof and the like. In various embodiments, the insulation component 208 may comprise a vinyl acetate thermoplastic resin polymer further comprising a mixture of a fire retardant (FR), preferably phosphorous based, ceramic components, reflective metal, expanded alumina, and pigment. In various embodiments, the multispectral signature mitigation component 210 may comprise one or more radar absorption material (RAM) and boron nitride. In various embodiments, the IR anti-reflective component 212 may comprise calcium carbonate and barium sulfate. The resulting vector control composite system 202, substrate 204 combined with coating 206 and vector control composition, may be cut and sewn for a variety of applications, such as nets, clothing, garments, tents and temporary shelters, among others. Substrate 204 may include the use of knit fabrics such as clothing and woven fabrics such as tents. The resulting vector control composite system, substrate combined with coating composition, may be cut and sewn for a variety of applications; e.g., nets, clothing, garments, tents and temporary shelters, among others. These products enable the shielding of thermal, vibrational, or gray body emitter behind it or underneath it in a multispectral manner and to resonate with nature outside of mosquito targeting frequencies while also applying structural design and thermal resonance of a spider web as an additional avoidance mechanism.

Figure 3:
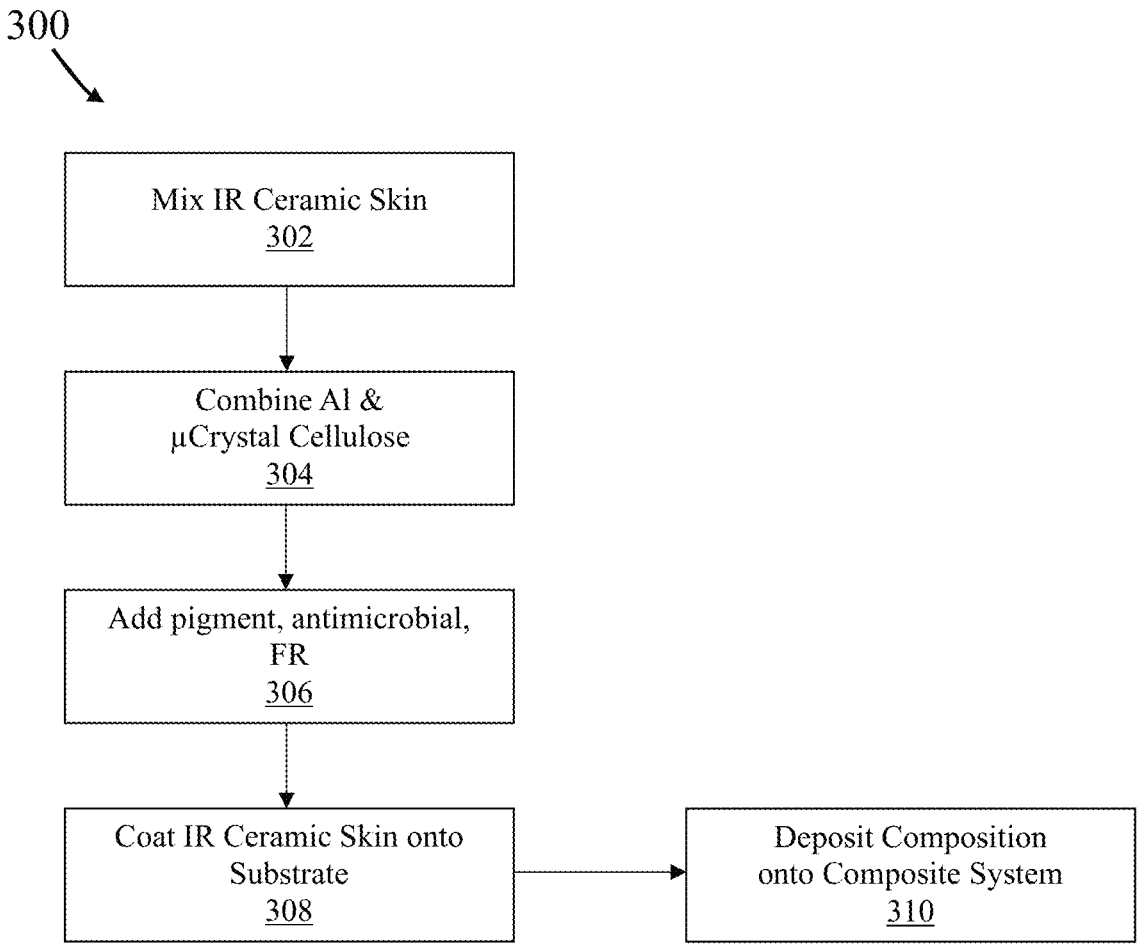
FIG. 3 is a flow diagram of a process for constructing a vector control composition and system, in accordance with certain aspects of the present disclosure.

Aspects of the present disclosure provide for a method for constructing a vector control composite system. Referring now to FIG. 3, a flow diagram 300 of a process for constructing a vector control composite system is shown, according to various embodiments. In a first step 302, the IR ceramic polymer skin 206 of FIG. 2 is mixed using a chosen binder, preferably a vinyl acetate, whereby calcium carbonate is combined with boron nitride, conductive carbon, carbon nanotubes, conductive graphite, or graphite. In an alternative embodiment, the chosen binder may comprise polyvinyl acetate, polyvinyl chloride, polyurethane, or silicone binder. In a second step 304, expanded alumina, microcrystalline cellulose is further combined. In a third step 306, a chosen pigment, antimicrobial, or a fire retardant are further added, and the mixture viscosity is adjusted to enable optimal application to the base substrate 204 of FIG. 2. In a fourth step 308, the IR ceramic coating 206 of FIG. 2 is coated onto the substrate 204 of FIG. 2 as a Faraday cage pattern via screen printing. In an exemplary embodiment, the Faraday cage pattern is printed with one or more apertures having a uniform or varying size in the range of 0.5 mm to 3 mm (i.e., each aperture in the one or more apertures may have a size in the range of 0.5 mm to 3 mm as measured in at least one direction). In certain embodiments, the plurality of random or ordered apertures are arranged to have a periodic separation distance in the range of 1.0 millimeters to 3.0 millimeters. The screen-printed pattern may comprise a broken pattern or a random pattern. In an alternative embodiment, the Faraday cage pattern is blotch coated as a single continuous layer. In another alternative embodiment, the Faraday cage pattern is gravure printed as a solid coating of a thickness corresponding to a chosen insulative value, whereby thicker coatings have higher IR thermal signature mitigation performance. This coating or skin can be mixed in a high or low temperature thermoplastic polyvinyl acetate, polyvinyl chloride, polyurethane, or silicone binder and printed with a Faraday cage pattern or blotch coated and heated to approximately 300-400 degrees Fahrenheit. In an optional final step 310, the vector control composition comprising one or more nanoparticles 102 of FIG. 1 may be deposited on the surface of the vector control composite system 202 of FIG. 2 via inkjet printing, among other methods. In an alternative embodiment, one or more spun bond non-woven textile made from various polymers such as PE, PU, Nylon, or natural fiber may be extruded with the same NP chemistry or variation of said NP chemistry to achieve a textile network of coated fibers or filaments spun bond into a textile. In certain embodiments, the coated fibers or filaments spun bond may be spun bond to define a random, webbed arrangement (e.g., resembling a spider web) (as shown in FIG. 4).

An aspect of the present disclosure is an IR ceramic coating 206 of FIG. 2 that may comprise all or some of the following attributes or specifications for the creation of regular or optimally coated Faraday pattern or blotch coated pattern or irregular pattern of conductive polymer designed to mitigate thermal, EM field signal, provide shielding in spectral ranges from x-ray to microwave to UV, Visible light, NIR, SWIR, and LWIR. The polymer coating (skin) 206 function in IR mitigation would follow the Rule of Threes, as follows. (1) Diffuse—sub-surface diffusion to mimic paper fractal reflection or subsurface diffusion; e.g., via broken surface of dots/specialized pigments enable surface coatings over the dots that provide photon transmission through an irregular broken surface nominally 800 to 1800 nm deep and refracted with various crystalline photonic refractive chemicals/metals. This layer would be composed of calcium carbonate, boron nitride and barium sulfate and aluminum flakes. (2) Absorb—photon absorption of EM would occur with the inclusion of a conductive carbon or carbon nanotube matrix. (3) Insulate/Reflect—insulate body heat inside or faced to the Sun. The insulation layer 208 of FIG. 2 provides a form of protection from conductive heat sources or excessive heat radiation with the use of expanded alumina and fused silica aided by the boron nitride. The IR ceramic skin 206 construction may comprise: 1-20% RAM (highly conductive carbon/conductive graphite/expanded graphite/expanded graphite oxide mixture with binder/cross binder); 1-20% Aluminum (reflectant); 1-20% Thermal Plastic/Vinyl Acetate Binder polymer (alternate may include polyvinyl acetate, polyvinyl chloride, polyurethane, or silicone binder polymer, among others); 1-20% Calcium Carbonate; 1-20% Fused Silica; 1-20% Expanded Alumina; 1-20% Microcrystalline Cellulose or cellulose nano fibers; 1-20% Boron Nitride; 1-20% Barium Sulfate; (1-20%) optional pigment or whitener (e.g. TiO2); (1-20%) optional Fire Retardant; and substrate 204 of FIG. 2 of any disclosed textile substrate woven, non-woven, or knit fabric. In an exemplary embodiment, IR ceramic coating 206 of FIG. 2 may comprise a 200-lb mix consisting of the following components listed in the order of addition: 8% Water=127.6 lb.; 1.5% Tic Gum=3-lb (thickener) 11.8% 23.6 lb. (urethane) or polyvinyl acetate; 7.4% Cellulose Nano Fibrils (CNF)=14.8 lb.; 5.5% Aeoxide ALUC (aluminum oxide CAS 1344-28-1)=11 lb.; 2% BN=4 lb.; 10% BS=20 lb.; 2% calcium carbonate=4 lb.; 2% conductive carbon/conductive graphite/or expanded graphite or graphene=4 lb. In an alternative embodiment, a standard mosquito net may be coated with a said conductive carbon, or graphite/conductive graphite or expanded graphite.

Figure 4:
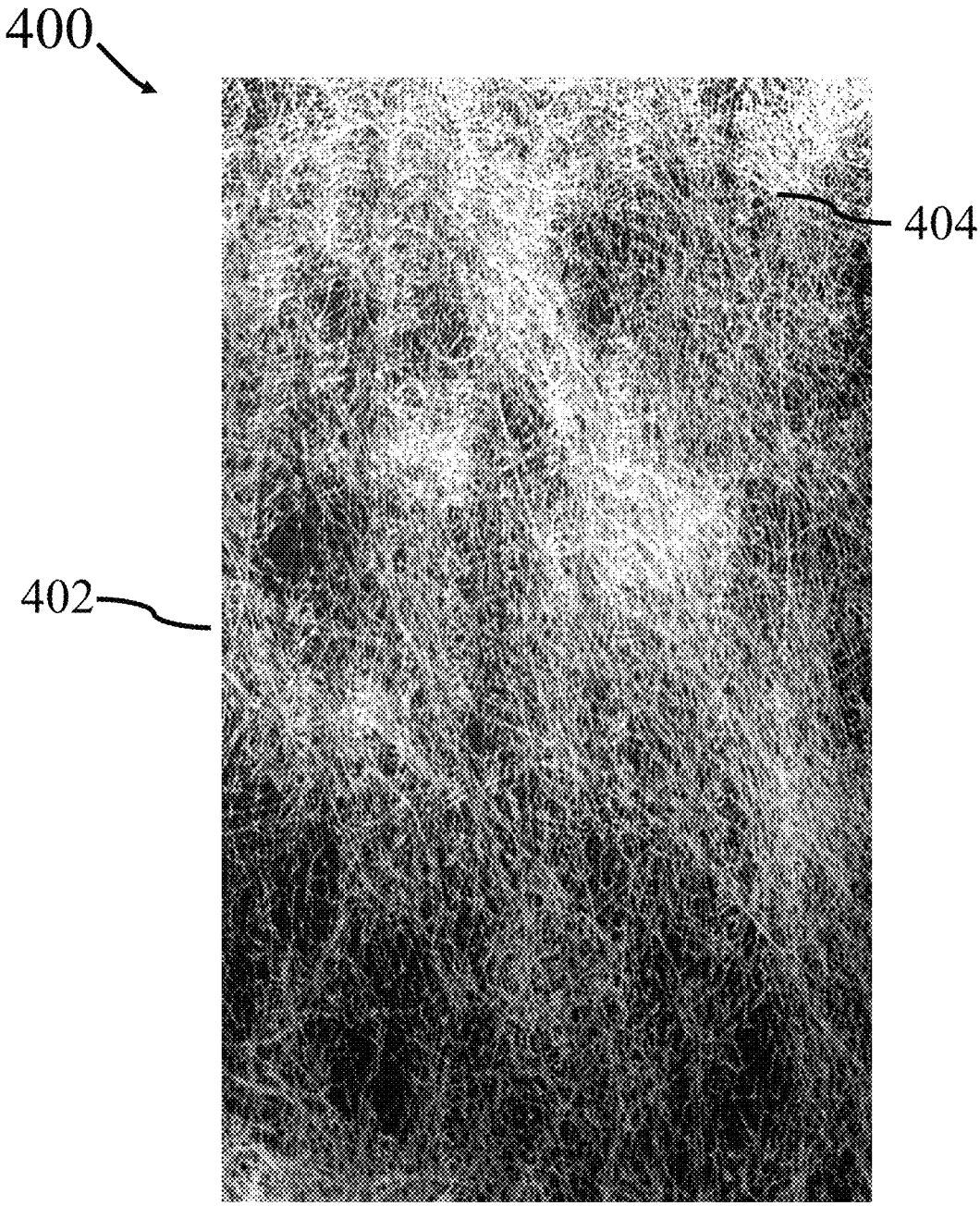
FIG. 4 is a photograph of an exemplary fiber arrangement for the vector control composition, in accordance with certain aspects of the present disclosure.

Referring now to FIG. 4, a photograph 400 of a vector control composite system sample 402 is shown. As illustrated in FIG. 4, a textile network of coated fibers 404 has been fabricated to resemble a spider's web. The vector control composite system mimics a nature obstacle that mosquitoes avoid in their visual and sensing process to aid in the shielding of the target with an obstruction typically encountered in nature versus an unnatural grid pattern of a standard mosquito net. The system design also aids in occluding thermal heat signal from escaping through relatively large holes or grids or apertures. The more random open spiderweb-like coated fibers 404 offers a perfect combination of biomimicry and random fiber orientations to form a truly unique and novel signature mitigation of host-seeking from mosquito vision and sensory perception. Thus, the vector control composite system of the present disclosure provides a unique vector control strategy that tricks a mosquito to abandon host-seeking in comparison with the use of a conventional net or garment for protection, which merely function to prevent the mosquito from contacting the user's skin. When the resultant fabric is placed in nature, it mimics the surrounding emissivity and aides directly in shielding the human or animal behind it or underneath it from IR signature in all three thermal IR ranges uniformly by creating a unique gray body thermal emissivity.

Figure 5:
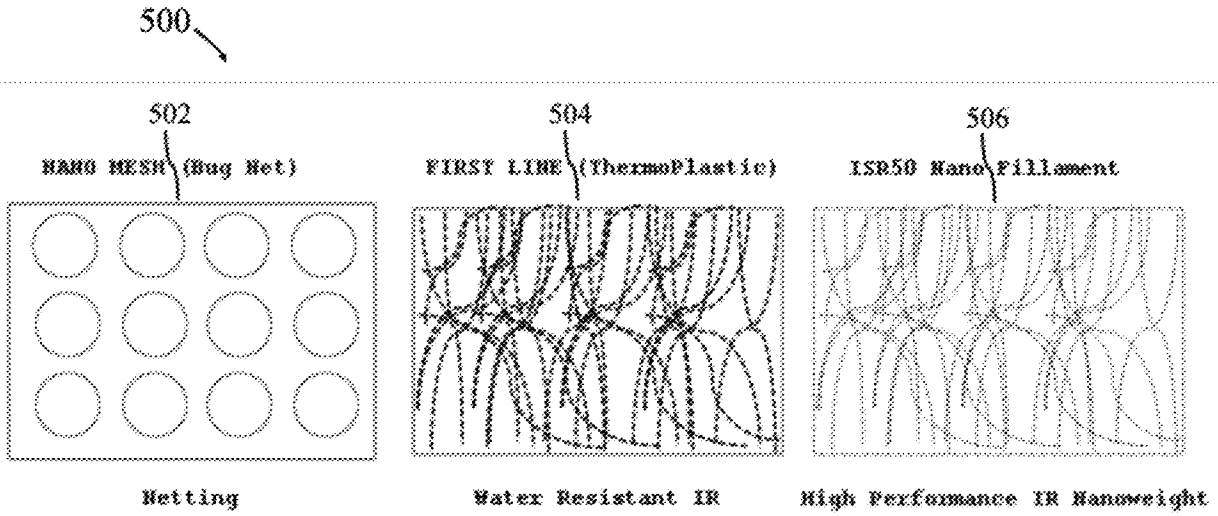
FIG. 5 is a pictorial of three different mosquito netting styles, in accordance with certain aspects of the present disclosure.

The present disclosure may comprise at least one fabric, textile, tent, or netting capable of blocking the infrared receptors of a mosquito from activating into targeting or host-seeking mode at the receptor protein level, vibrational/chemical reacting level of electromagnetic wavelength and frequencies by purposely obscuring thermal, vibration, gray body, and human heat energy emission signature. In certain embodiments, the conductive textile comprises a plurality of fibers configured to mimic a spiderweb pattern and to have a transparent capability with a plurality of random apertures being equal to or less than the perforation size of the recommended WHO mosquito net construction in a high malaria risk area. The present disclosure enables the mitigation of human IR emission with a conductive textile, thermally insulative materials of nano cellulose, expanded aluminum, and spun bond non-woven textile configured to mimic a spiderweb design commonly found in nature. Referring now to FIG. 5, a pictorial 500 of three different mosquito netting styles is shown, according to various embodiments. In one embodiment, a nano mesh 502 may comprise a mesh having an ordered pattern comprising a mesh sieve with uniform or ordered spacing between the mesh openings. The mesh sieve size of nano mesh 502 (i.e., the size of the mesh openings) may be less than or equal to 1.5 mm. Nano mesh 502 may have a mesh density of 156 holes (i.e., mesh openings) per square inch or 25 holes per square centimeter. In another embodiment, a first line 504 may comprise one or more fibers that are extruded with the IR ceramic coating (e.g., IR ceramic coating 206 of FIG. 2) being coated thereon. First line 504 is preferably water resistant and fabricated using one or more thermoplastic. In yet another embodiment, ISR50 Nano filament 506 may comprise high performance IR nano weight of extremely low thermal density.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." As used herein, the terms "right," "left," "top," "bottom," "upper," "lower," "inner" and "outer" designate directions in the drawings to which reference is made.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one of a number or lists of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention.

What is claimed is:

1. A vector control composition comprising:

a substrate layer comprising a fabric substrate; and an infrared ceramic coating layer disposed on a surface of the substrate layer, wherein the infrared ceramic coating layer comprises a single infrared ceramic polymer skin comprising an insulation layer, a multi-spectrum signature mitigation layer, and an infrared anti-reflective layer, wherein the insulation layer comprises a vinyl acetate thermoplastic resin polymer, expanded alumina, and fused silica, wherein the multi-spectrum signature mitigation layer comprises at least one radar absorption material and a conductive carbon or carbon nanotube matrix, wherein the infrared anti-reflective layer comprises a plurality of nanoparticles comprising one or more calcium carbonate nanoparticles and one or more barium sulfate nanoparticles, and further comprises boron nitride and aluminum flakes, wherein the infrared ceramic coating layer is screen-printed on the surface of the substrate layer in a Faraday cage pattern defining a plurality of apertures, each aperture having a size in a range of 0.5 millimeters to 3 millimeters and a periodic separation distance in a range of 1.0 millimeters to 3.0 millimeters, and wherein the infrared ceramic coating layer is configured to shield thermal, vibrational, or gray body energy emitted from a human or animal subject behind or underneath the vector control composition to interfere with mosquito infrared host-seeking cues.

2. The vector control composition of claim 1 wherein the fabric substrate comprises a nylon 6,6 spun bond fabric.

3. The vector control composition of claim 1 wherein the fabric substrate comprises a plurality of fibers being spun bonded to comprise a webbed arrangement.

4. The vector control composition of claim 1 wherein the multi-spectrum signature mitigation layer comprises boron nitride particles and conductive graphite in combination with the conductive carbon or carbon nanotube matrix.

5. The vector control composition of claim 1 wherein the fabric substrate comprises a mesh fabric having a mesh opening size of less than or equal to 1.5 millimeters.

6. The vector control composition of claim 1 wherein the insulation layer further comprises one or more of a phosphorous-based fire retardant, ceramic particles, reflective metal particles, and a pigment.

7. A vector control composition comprising:

a fabric substrate; and an infrared ceramic coating comprising a single infrared ceramic polymer skin including an insulation component, a multi-spectrum signature mitigation component, and an infrared anti-reflective component, wherein the insulation component comprises a vinyl acetate thermoplastic resin polymer, expanded alumina, and fused silica, wherein the multi-spectrum signature mitigation component comprises at least one radar absorption material and a conductive carbon, carbon nanotube, conductive graphite, or graphite matrix, wherein the infrared anti-reflective component comprises a plurality of nanoparticles comprising one or more calcium carbonate nanoparticles and one or more barium sulfate nanoparticles, and further comprises boron nitride and aluminum flakes, wherein the infrared ceramic coating comprises a mixture that is disposed on a surface of the fabric substrate, wherein the mixture is screen-printed on the surface of the fabric substrate as a Faraday cage pattern defining a plurality of apertures, each aperture having a size in a range of 0.5 millimeters to 3 millimeters and a periodic separation distance in a range of 1.0 millimeters to 3.0 millimeters, and wherein the infrared ceramic coating is configured to shield thermal, vibrational, or gray body energy emitted from a human or animal subject behind or underneath the vector control composition to interfere with mosquito infrared host-seeking cues.

8. The vector control composition of claim 7 wherein the Faraday cage pattern comprises an ordered pattern, a broken pattern, or a random pattern.

9. The vector control composition of claim 7 wherein the infrared ceramic coating is disposed on the surface of the fabric substrate to define a Faraday cage pattern that assists in electrical conduction, thermal infrared absorption, and transmission.

10. The vector control composition of claim 7 wherein the plurality of apertures comprise uniform or varying sizes measured in at least one direction.

11. The vector control composition of claim 7 wherein the infrared ceramic coating comprises a broken surface configured for sub-surface diffusion of infrared radiation.

12. The vector control composition of claim 7 wherein the fabric substrate comprises a nylon 6,6 spun bond fabric.

13. The vector control composition of claim 7 wherein the fabric substrate comprises a plurality of fibers being spun bonded to comprise a webbed arrangement.

14. The vector control composition of claim 7 wherein the fabric substrate comprises a mesh fabric having a mesh opening size of less than or equal to 1.5 millimeters.

15. A vector control composition comprising:

a plurality of fibers; and an infrared ceramic coating deposited on the plurality of fibers, wherein the infrared ceramic coating comprises an insulation component, a multi-spectrum signature mitigation component, and an infrared anti-reflective component, wherein the insulation component comprises a vinyl acetate thermoplastic resin polymer, expanded alumina, and fused silica, wherein the multi-spectrum signature mitigation component comprises at least one radar absorption material and a conductive carbon, carbon nanotube, conductive graphite, or graphite matrix, wherein the infrared anti-reflective component comprises a plurality of nanoparticles comprising one or more calcium carbonate nanoparticles and one or more barium sulfate nanoparticles, and further comprises boron nitride and aluminum flakes, wherein the plurality of fibers are spun bonded to comprise a textile, wherein the plurality of fibers comprise coated fibers or coated filaments spun bonded to define a random webbed arrangement, and wherein the infrared ceramic coating is configured to shield thermal, vibrational, or gray body energy emitted from a human or animal subject behind or underneath the textile to interfere with mosquito infrared host-seeking cues.

16. The vector control composition of claim 15 wherein the plurality of fibers comprise a webbed arrangement when spun bonded to comprise the textile.

17. The vector control composition of claim 15 wherein the multi-spectrum signature mitigation component comprises boron nitride particles and one or more of conductive carbon, conductive graphite, expanded graphite, graphene, and carbon nanotubes.

18. The vector control composition of claim 15 wherein the insulation component further comprises one or more of a phosphorous-based fire retardant, ceramic particles, reflective metal particles, and a pigment.

19. The vector control composition of claim 15 wherein the textile is configured as a wearable garment.

20. The vector control composition of claim 16 wherein the webbed arrangement comprises a random arrangement of the plurality of fibers.

* * * * *